US005220795A

United States Patent [19]

Dodds et al.

[11] Patent Number: 5,220,795

[45] Date of Patent: Jun. 22, 1993

[54] METHOD AND APPARATUS FOR INJECTING DILUTION AIR

[75] Inventors: Willard J. Dodds, West Chester, Ohio; Stanley K. Widener, San Antonio, Tex.; Keith K. Taylor, Cincinnati, Ohio; Howard L. Foltz, West Chester, Ohio; Steven C. Steffens, Cincinnati, Ohio

[73] Assignee: General Electric Company, Cincinnati, Ohio

[21] Appl. No.: 685,938

[22] Filed: Apr. 16, 1991

[51] Int. Cl.[5] ..... F02C 3/00; F23R 3/08

[52] U.S. Cl. ..... 60/747; 60/757

[58] Field of Search ..... 60/39.02, 747, 752, 60/754, 755, 756, 757, 758, 759, 760, 753, 39.23, 39.36

[56] References Cited

U.S. PATENT DOCUMENTS

| | | | |
|---|---|---|---|
| 2,586,751 | 2/1952 | Watson et al. | 60/752 |
| 2,658,339 | 11/1953 | Bonsall | 60/752 |
| 2,664,702 | 1/1954 | Lloyd et al. | 60/752 |
| 3,132,483 | 5/1964 | Lefebvre et al. . | |
| 3,680,310 | 9/1971 | Vaught | 60/752 |
| 3,851,465 | 12/1974 | Verdouw | 60/39.36 |
| 4,173,118 | 11/1979 | Kawaguchi | 60/39.65 |
| 4,246,758 | 1/1981 | Caruel et al. | 60/749 |
| 4,249,373 | 2/1981 | Sotheran et al. | 60/39.36 |
| 4,374,466 | 2/1983 | Sotheran | 60/738 |
| 4,399,652 | 8/1983 | Cole et al. | 60/39.465 |
| 4,903,492 | 2/1990 | King | 60/733 |

FOREIGN PATENT DOCUMENTS

| | | |
|---|---|---|
| 2293591 | 2/1976 | France . |
| 00943250 | 12/1963 | United Kingdom . |
| 2097113A | 4/1981 | United Kingdom . |
| 2090960A | 7/1982 | United Kingdom . |
| 2107448A | 4/1983 | United Kingdom . |

OTHER PUBLICATIONS

D. L. Burrus et al., Energy Efficient Engine, Combustion System Component Technology Development Report, NASA Report R82AEB401, Nov. 1982, pp. Cover, Title, 1-13, 81, 84-88, and 456.

Northern Research and Engineering Corporation (N.R.E.C.). The Design and Development of Gas Turbine Combustors, 1980, pp. Cover, iii, 3.1-3.5, 3.28-3.36, 3.40, 3.65, 3.80, 3.86, 3.87 and 3.89.

Lefebvre, Arthur H. *Gas Turbine Combustion*, New York, N.Y.: McGraw-Hill, 1983, pp. 143-144.

*Primary Examiner*—Richard A. Bertsch
*Assistant Examiner*—Timothy S. Thorpe
*Attorney, Agent, or Firm*—Jerome C. Squillaro; James P. Davidson

[57] ABSTRACT

A method of diluting combustion gases in a gas turbine engine combustor includes injecting primary dilution air into the combustion gases, and injecting trim dilution air into the combustion gases adjacent to the injected primary dilution air. A dilution air injector for practicing the method includes a plate, or centerbody in an exemplary embodiment, having a primary dilution hole for injecting a portion of compressed air into combustion gases as primary dilution air, and a trim dilution hole for injecting a portion of the compressed air into the combustion gases as trim dilution air. The primary and trim dilution holes are sized and configured so that the primary and trim dilution air cooperate with each other for penetrating into and diluting a predetermined portion of the combustion gases.

13 Claims, 5 Drawing Sheets

METHOD AND APPARATUS FOR INJECTING DILUTION AIR

The Government has rights in this invention pursuant to Contract No. F33657-83-C-0281 awarded by the Department of the Air Force.

TECHNICAL FIELD

The present invention relates generally to gas turbine engine combustors, and, more specifically, to a method and apparatus for injecting dilution air into a combustor.

BACKGROUND ART

A gas turbine engine combustor mixes fuel with compressed air for generating combustion gases which are channeled to a turbine which extracts energy therefrom. A typical combustor includes various passages and holes for channeling preselected portions of compressed air from a compressor for performing various functions. A portion of the compressed air is channeled through conventional carburetors for generating fuel-air mixtures which are ignited for generating combustion gases. Another portion of the compressed air is channeled through conventional primary air holes for supporting combustion to ensure that substantially all of the fuel is completely burned. Another portion of the compressed air is channeled into the combustor through dilution air holes for quenching the temperature of the combustion gases and providing acceptable profile and pattern factors, i.e., acceptable temperature distribution, of the combustion gases to the turbine vanes and blades for obtaining acceptable life thereof.

The combustor also typically includes various cooling air holes for channeling additional portions of the compressed air for cooling the dome, carburetor baffle plates, and the combustor liners themselves through, for example, conventional film cooling air nuggets which channel a layer of cooling air along the inner surfaces of the liners for protecting the liners from the hot combustion gases.

A continuing trend in designing gas turbine engine combustors is to reduce combustor length, and length-to-height (L/H) ratio, for reducing engine weight, and increasing engine performance by decreasing the amount of compressor air used for cooling the combustor. However, as combustor length is reduced, it becomes increasingly difficult to obtain adequate penetration of dilution air into, and mixing with, the combustion gases for obtaining acceptable combustion gas exit temperatures. Accordingly, the L/H ratio, which is a primary factor in obtaining acceptable combustor performance, is approaching its smallest limit for conventional combustors.

In order to further reduce overall combustor length, double annular, or double dome combustor designs are being considered since they utilize basically two radially outer and inner combustion zones each having an acceptable L/H ratio while obtaining further decrease in overall combustor length. However, in such double dome combustors, the ability to obtain adequate dilution air penetration and mixing additionally becomes increasingly difficult in view of the relatively short combustor length. Conventional dilution air holes disposed in the combustor liners, are therefore, limited in their ability to obtain acceptable temperature profile and pattern factors.

OBJECTS OF THE INVENTION

Accordingly, one object of the present invention is to provide a new method and apparatus for injecting dilution air into a gas turbine engine combustor.

Another object of the present invention is to provide a combustor dilution air injector having improved dilution air penetration into combustion gases for decreasing temperature variations therein.

Another object of the present invention is to provide a dilution air injector for a double dome combustor for diluting combustion gas hot streaks emanating downstream from carburetors in a combustor dome.

Another object of the present invention is to provide a double dome combustor centerbody having an improved dilution air injector.

DISCLOSURE OF INVENTION

A method of diluting combustion gases in a gas turbine engine combustor includes injecting primary dilution air into the combustion gases, and injecting trim dilution air into the combustion gases adjacent to the injected primary dilution air. A dilution air injector for practicing the method includes a plate, or centerbody in an exemplary embodiment, having a primary dilution hole for injecting a portion of compressed air into combustion gases as primary dilution air, and a trim dilution hole for injecting a portion of the compressed air into the combustion gases as trim dilution air. The primary and trim dilution holes are sized and configured so that the primary and trim dilution air cooperate with each other for penetrating into and diluting a predetermined portion of the combustion gases.

BRIEF DESCRIPTION OF DRAWINGS

The novel features believed characteristic of the invention are set forth and differentiated in the claims. The invention, in accordance with a preferred and exemplary embodiment, together with further objects and advantages thereof, is more particularly described in the following detailed description taken in conjunction with the accompanying drawing in which:

MODE(S) FOR CARRYING OUT THE INVENTION

Figure 1:
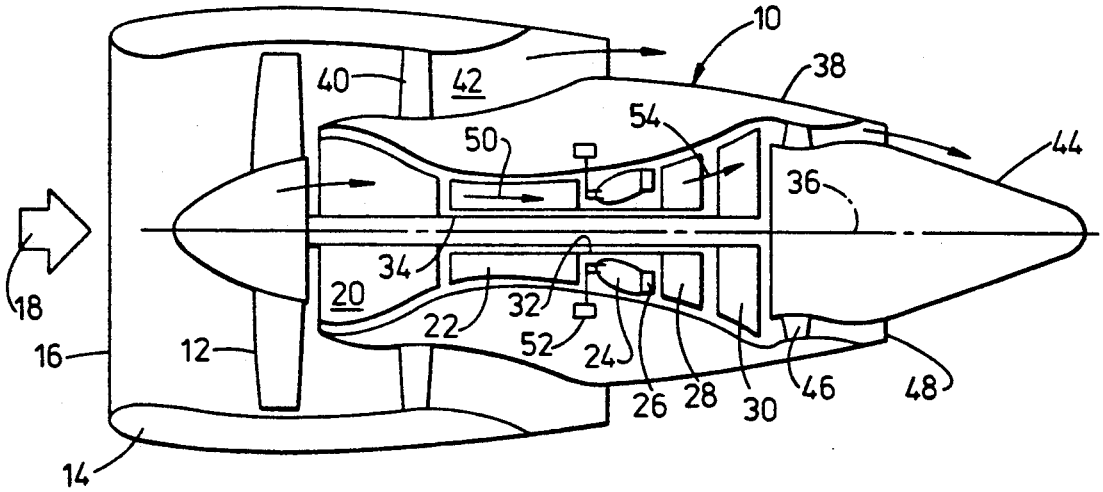
FIG. 1 is a longitudinal schematic view of a high bypass turbofan gas turbine engine including a combustor in accordance with one embodiment of the present invention.

Illustrated in FIG. 1 is a longitudinal sectional schematic view of an exemplary high bypass turbofan engine 10. The engine 10 includes a conventional fan 12 disposed inside a fan cowl 14 having an inlet 16 for receiving ambient air 18. Disposed downstream of the fan 12 is a conventional lower pressure compressor (LPC) 20 followed in serial flow communication by a conventional high pressure compressor (HPC) 22, a combustor 24, a conventional high pressure turbine nozzle 26, a conventional high pressure turbine (HPT)

28, and a conventional low pressure turbine (LPT) 30. The HPT 28 is conventionally fixedly connected to the HPC 22 by an HP shaft 32, and the LPT 30 is conventionally connected to the LPC 20 by a conventional LP shaft 34. The LP shaft 34 is also conventionally fixedly connected to the fan 12. The engine 10 is symmetrical about a longitudinal, or axial, centerline axis 36 disposed through the HP and LP shafts 32 and 34.

The fan cowl 14 is conventionally fixedly attached to and spaced from an outer casing 38 by a plurality of circumferentially spaced conventional struts 40 defining therebetween a conventional annular fan bypass duct 42. The outer casing 38 surrounds the engine 10 from the LPC 20 to the LPT 30. A conventional exhaust cone 44 is spaced radially inwardly from the casing 38 and downstream of the LPT 30, and is fixedly connected thereto by a plurality of conventional circumferentially spaced frame struts 46 to define an annular core outlet 48 of the engine 10.

During operation, the air 18 is compressed in turn by the LPC 20 and HPC 22 and is then provided as compressed air 50 to the combustor 24. Conventional fuel injection means 52 provide fuel to the combustor 24 which is mixed with the compressed air 50 and undergoes combustion in the combustor 24 for generating combustion discharge gases 54. The gases 54 flow in turn through the HPT 28 and the LPT 30 wherein energy is extracted for rotating the HP and LP shafts 32 and 34 for driving the HPC 22, and the LPC 20 and fan 12, respectively.

Figure 2:
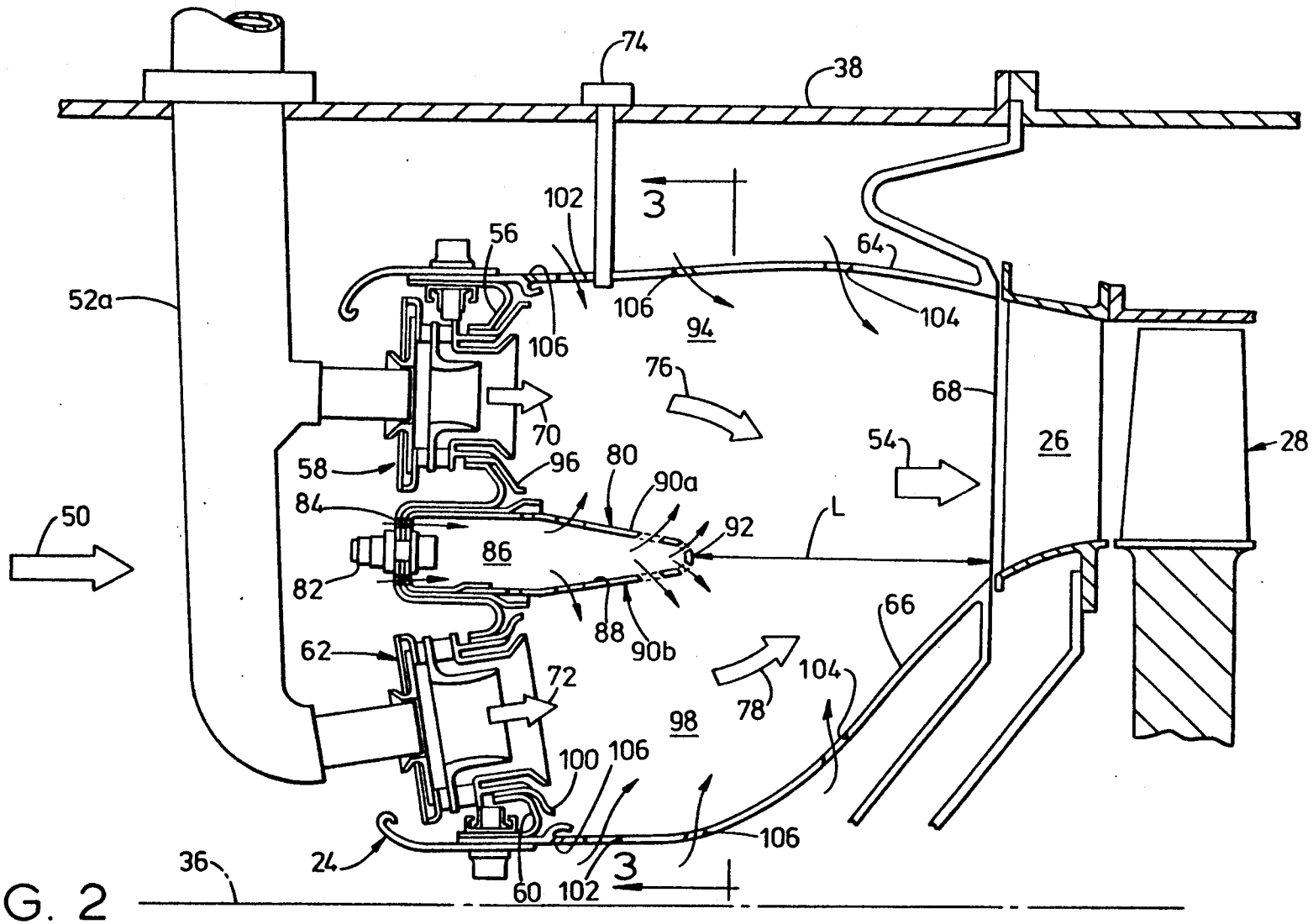
FIG. 2 is an enlarged longitudinal, partly sectional view of the combustor illustrated in FIG. 1.

Illustrated in FIG. 2 is an enlarged longitudinal sectional view of the combustor 24. At its upstream end, the combustor 24 includes an annular outer dome 56 having a plurality of circumferentially spaced conventional outer carburetors 58, and an annular radially inner dome 60 having a plurality of circumferentially spaced conventional inner carburetors 62. Conventional annular outer and inner combustor liners 64 and 66, respectively, are disposed coaxially about the centerline axis 36 and extend downstream from the outer and inner domes 56 and 60, respectively, to an annular combustor outlet 68 defined at the downstream ends of the liners 64 and 66.

Each of the carburetors 58 and 62 includes a conventional counterrotational swirler for channeling a portion of the compressed air 50 which is mixed with fuel from a conventional fuel injector joined to a fuel stem 52*a* of the fuel injection means 52. The carburetors 58 and 62 conventionally provide outer and inner fuel-air mixtures 70 and 72, respectively into the combustor 24 which are ignited by a conventional igniter 74 for generating outer and inner combustion gases 76 and 78, respectively.

In accordance with one embodiment of the present invention, a dilution air injector 80 in the exemplary form of an annular plate, or hollow annular centerbody, extends downstream from between the outer and inner domes 56 and 60 and is spaced radially from both the outer and inner liners 64 and 66. The centerbody 80 is fixedly joined to the outer and inner domes 56 and 60 by a plurality of circumferentially spaced bolts 82.

The centerbody 80 includes at its upstream end a plurality of circumferentially spaced inlets 84 which extend through the junction of the domes 56 and 60 and between adjacent ones of the bolts 82 for channeling a portion of the compressed air 50 into a plenum 86 defined by an upstream side, or inner surface, 88 of the centerbody 80 against which is received the compressed air 50 through the inlets 84. The centerbody 80 further includes a downstream side, or outer surface, 90 which faces the combustion gases 76 and 78.

More specifically, the outer surface 90 is in the form of an upper surface 90*a* and a lower surface 90*b* converging in the downstream direction to join each other at an annular trailing edge 92 spaced upstream from the combustor outlet 68. The centerbody upper surface 90*a* is spaced radially inwardly from the outer liner 64 to define an outer combustion zone 94 which extends downstream from a plurality of conventional, circumferentially spaced outer baffles or splash plates 96 extending outwardly from each of the outer carburetors 58. The centerbody lower surface 90*b* is spaced radially outwardly from the inner liner 66 to define an inner combustion zone 98 extending downstream from a plurality of conventional, circumferentially spaced inner baffles, or splash plates 100 extending outwardly from the inner carburetors 62.

During operation, the outer and inner combustion gases 76 and 78 flowing downstream from the outer and inner carburetors 58 and 62 in the outer and inner combustion zones 94 and 98, respectively, flow over the centerbody 80 and mix with each other downstream of the centerbody trailing edge 92. The trailing edge 92 is preferably spaced upstream from the combustor outlet 68 at a predetermined distance L to allow for at least some mixing of the outer and inner combustion gases 76 and 78. In this exemplary embodiment of the present invention, the outer combustion zone 94 is a pilot combustion zone which operates at all output power levels of the combustor 24 from idle to maximum power. The inner combustion zone 98 is the main combustion zone which is operated only above low power or idle for providing a majority of power from the combustor 24. The outer, or pilot, fuel-air mixture 70 is initially ignited by the igniter 74 to form the pilot combustion gases 76 which in turn ignite the inner fuel-air mixture 72 for generating the inner, or main, combustion gases 78.

The outer and inner liners 64 and 66 include conventional liner primary holes 102 at the upstream ends thereof, and at intermediate portions thereof they also include conventional liner dilution holes 104. The liner primary holes 102 provide an additional portion of the compressed air 50 for supporting and substantially completing combustion of the fuel-air mixtures 70 and 72, or combustion gases 76 and 78. The liner dilution holes 104 provide conventional jets of another portion of the compressed air 50 which are injected into the combustion gases 76 and 78 for conventional dilution purposes for quenching the temperature thereof and reducing hot streaks and peak temperatures therein. The diluted combustion gases 76 and 78 are discharged from the combustor outlet 68 as the combustion discharge gases 54.

The outer and inner combustor liners 64 and 66 are conventionally cooled, for example by conventional film cooling nuggets 106 at upstream ends thereof which form boundary layers of film cooling air which extend downstream along the inner surfaces of the liners 64 and 66. In the exemplary embodiment illustrated, the liners 64 and 66 include respective pluralities of cooling holes 106, only two of which are shown, which are inclined in the downstream direction at about 20° relative to the liner surface for cooling the liners 64 and 66 by convection flow through the holes 106 and by forming a film cooling boundary of air along the inner surfaces of the liners 64 and 66.

Figure 3:
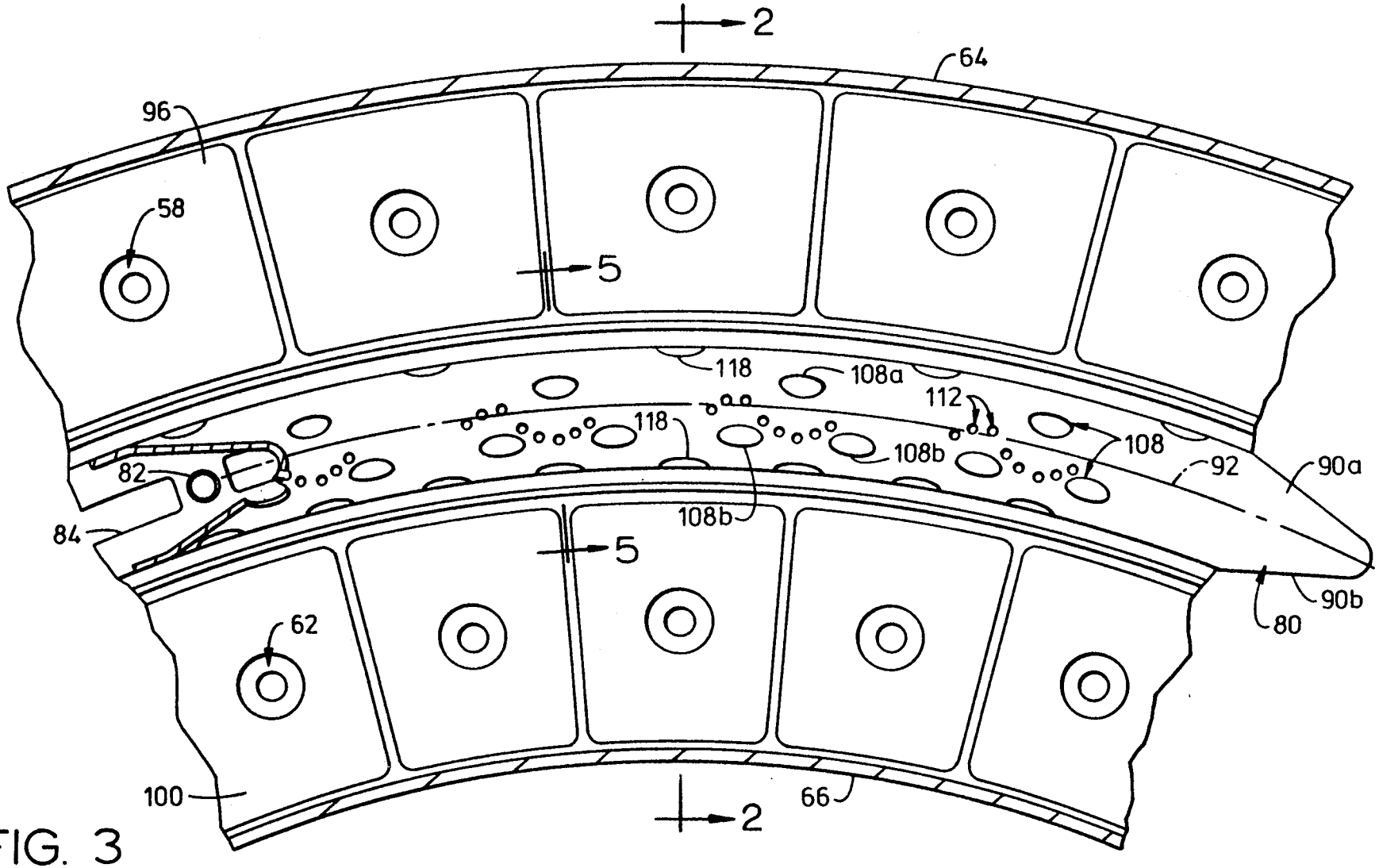
FIG. 3 is an upstream facing view of a portion of the combustor illustrated in FIG. 2 taken along line 3—3.
Figure 4:
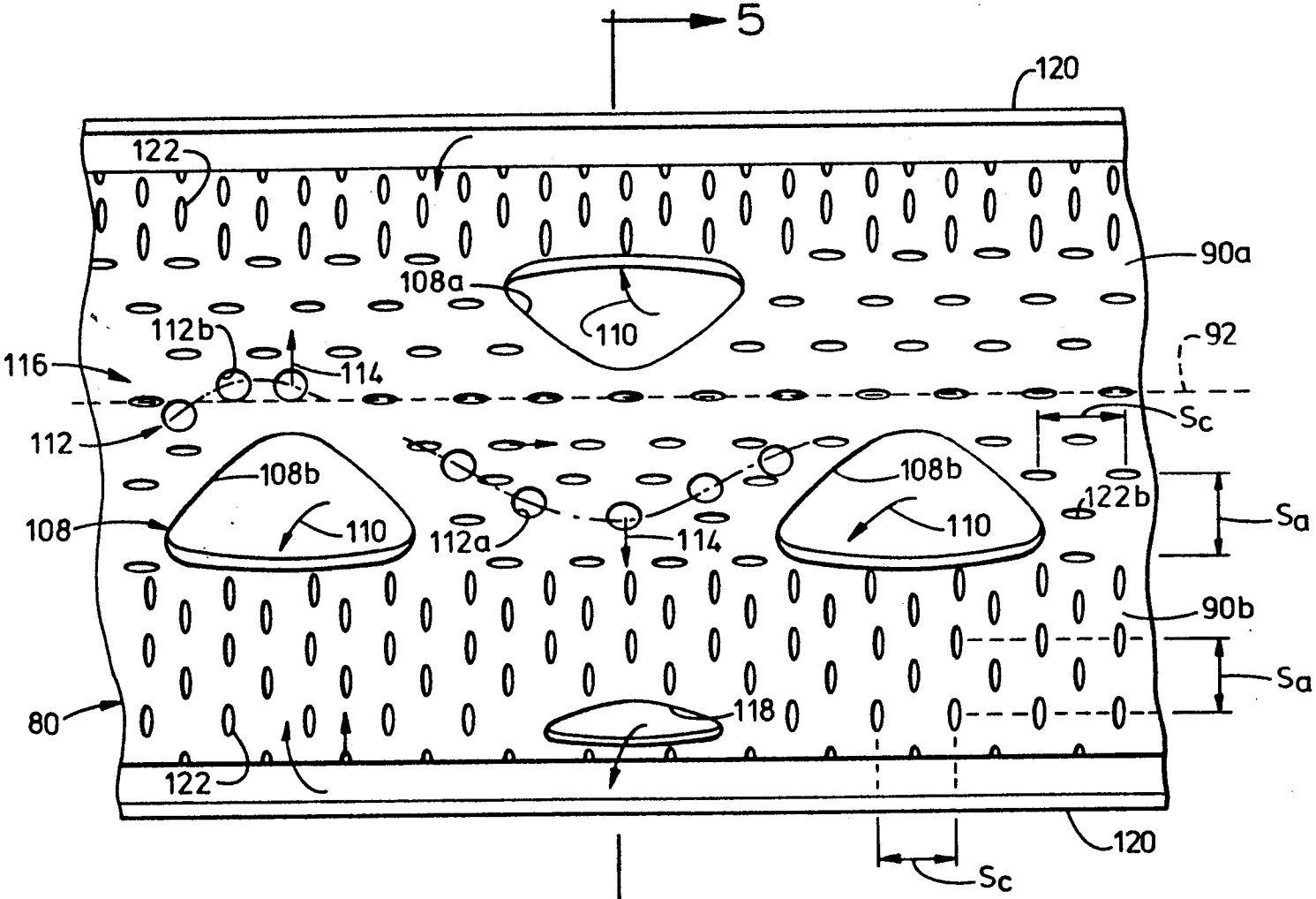
FIG. 4 is an enlarged upstream facing view of a portion of the centerbody illustrated in FIG. 3.
Figure 5:
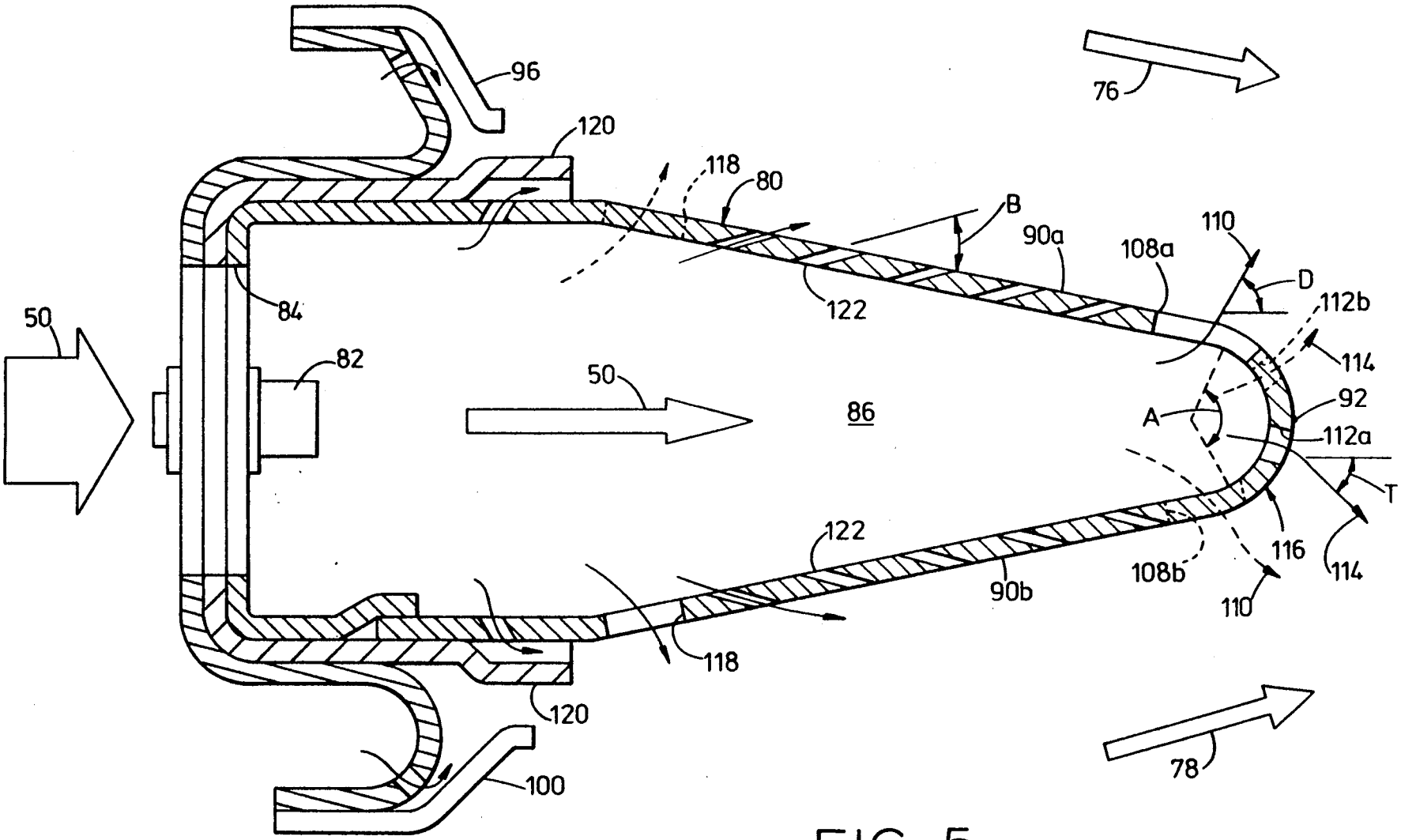
FIG. 5 is a longitudinal sectional view of the centerbody and adjacent structures illustrated in FIGS. 3 and 4 taken along lines 5—5 therein.

Since the double dome, or double annular combustor 24 is relatively short in the axial direction, the conventional liner dilution holes 104 are limited in their ability to obtain acceptable penetration of the dilution air jets therethrough for providing acceptable dilution of the combustion gases 76 and 78. In accordance with one embodiment of the present invention as illustrated in FIGS. 3–5, the centerbody 80 further includes a plurality of circumferentially spaced primary dilution holes 108 extending therethrough for injecting a portion of the compressed air 50 into the combustion gases 76, 78 as primary dilution air 110. And, a plurality of circumferentially spaced trim dilution holes 112 extend through the centerbody 80 adjacent to the primary dilution holes 108 for injecting a portion of the compressed air 50 into the combustion gases 76, 78 as trim dilution air 114. The primary and trim dilution holes 108 and 112 are preferably sized and configured so that the primary and trim dilution air 110 and 114 cooperate with each other for penetrating into and diluting a predetermined portion or region of the combustion gases 76, 78.

More specifically, since the carburetors 58, 62 are circumferentially spaced, they generate circumferentially spaced regions of relatively hot outer and inner combustion gases 76 and 78. Accordingly, both circumferential and radial variations in temperature of the combustion gases 76 and 78 are created in the combustor 24 which must be effectively reduced for providing acceptable temperature profile of the combustion gases 54 to the HPT nozzle 26 and HPT 28. The size and configuration of the centerbody primary and trim dilution holes 108 and 112 may be determined by, for example, trial and error for effectively diluting the combustion gases 76 and 78 within the relatively short combustor 24. It is to be noted that the combustor aerodynamics and thermodynamics are three dimensional phenomena which are relatively complex. However, it is fundamental that a hot streak is generated downstream from each of the outer and inner carburetors 58 and 62. By utilizing the primary and trim dilution holes 108 and 112 in accordance with the present invention, these hot streaks may be reduced for obtaining improved temperature profiles of the combustion gases 54 for each particular design application. The number, size, and configuration of the primary and trim dilution holes 108, 112 will vary for each particular design as required to improve the profile and pattern factors.

For example, for the double dome combustor 24 illustrated in FIG. 2, the number, size and configuration of the primary and trim dilution holes 108 and 112 as generally illustrated in FIGS. 3–5 were found by test to provide improved combustion gas discharge temperature profile and pattern factors. As illustrated in the Figures, the primary and trim dilution holes 108 and 112 are preferably circular, although elliptical or other noncircular shapes could be used, with the primary dilution holes 108 being larger than the trim dilution holes 112. For each of the inner, or main, carburetors 62, the primary dilution holes 108 include an outer primary dilution hole **108*a* disposed in the centerbody upper surface 90*a* adjacent to the trailing edge 92, and an inner primary dilution hole 108*b* disposed in the centerbody lower surface 90*b* adjacent to the trailing edge 92**.

As illustrated in more particularly in FIG. 4, a plurality of the trim dilution holes 112 are disposed adjacent to and between the outer and inner primary dilution holes **108*a* and 108*b* adjacent to the trailing edge 92 for each of the inner carburetors 62. Since each of the inner carburetors 62 is aligned radially with a respective one of the outer carburetors 58, the configuration of the primary dilution holes 108 and trim dilution holes 112 repeats symmetrically around the circumference of the centerbody 80** for each of the inner and outer carburetor pairs.

In one embodiment of the present invention, the inner primary dilution holes **108*b* are disposed in pairs with the outer primary dilution hole 108*a* being disposed circumferentially and equidistantly between adjacent ones of the inner primary dilution holes 108*b* of the pair. In the preferred embodiment, the trim dilution holes 112 are disposed circumferentially between adjacent ones of the inner primary dilution holes 108*b* of each pair and are aligned generally circumferentially therewith. As illustrated in FIG. 4, in this exemplary embodiment there are five of these trim dilution holes 112, i.e. 112*a*, disposed between the adjacent inner primary dilution holes 108*b*. These five trim dilution holes 112*a* are also generally longitudinally aligned with the outer primary dilution hole 108*a*. Also in the exemplary embodiment illustrated in FIG. 4, three more trim dilution holes 112, i.e. 112*b*, are aligned generally longitudinally with one of the inner primary dilution holes 108*b* of the pair at the trailing edge 92**.

In the exemplary embodiment illustrated, the five trim dilution holes **112*a* disposed between adjacent ones of the inner primary dilution holes 108*b* are aligned along an arc which is concave and faces the outer primary dilution hole 108*a* positioned circumferentially between the inner primary dilution holes 108*b*. Similarly, the three trim dilution holes 112*b* disposed adjacent to the one inner primary dilution hole 108*b* are also aligned along an arc which is concave and faces that one inner primary dilution 108*b***.

Referring to both FIGS. 4 and 5, the centerbody 80 further includes an aft end 116 which is symmetrical relative to the centerbody 80 and is arcuate in longitudinal section to extend over an arc angle A of about 120°. The aft end 116 includes the trailing edge 92 disposed at its center. In the preferred embodiment, the primary and trim dilution holes 108 and 112 are disposed at least in part in the aft end 116 for injecting the compressed air 50 into the combustion gases 76, 78 at different angles. The centerbody upper and lower surfaces **90*a* and 90*b* preferably include straight portions extending upstream from the aft end 116 and to the outer and inner baffles 96 and 100, and the primary dilution holes 108** are also disposed at least in part in the straight portions.

More specifically, and as illustrated in FIG. 5, the upper primary dilution holes **108*a* and similarly the lower primary dilution holes 108*b*, are configured in the straight, inclined outer surface 90*a* and the arcuate aft end 116 so that the primary dilution air 110 is injected into the combustion gases 76 at an acute angle D relative to the engine, or combustor longitudinal centerline axis 36. Furthermore, the trim dilution holes 112 are configured in the arcuate aft end 116 so that the trim dilution air 114 is injected into the combustion gases 76, 78 at an acute angle T relative to the centerline axis 36. The primary dilution holes 108 and the trim dilution holes 112 are preferably configured for injecting the compressed air 50 into the combustion gases at different angles as required for each particular design application so that the primary dilution air 110 cooperates with the trim dilution air 114 for reducing the temperature variations in the combustion gases 76, 78 to a greater extent than that which could be obtained by using the primary dilution holes 108 alone. Furthermore, since each of the trim dilution holes 112 is positioned along the arc and the centerbody aft end 116, then each of the injection angles T of the individual trim dilution holes 112 will be different from each other. In this way, the different sizes and injection angles D and T, for the primary and trim dilution holes 108 and 112** may be effectively used for reducing temperature variations in the combustion gases.

Referring again to FIGS. 3–5, the centerbody 80 also includes centerbody primary air holes 118 for injecting a portion of the compressed air 50 as primary air for assisting in supporting combustion of the combustion gases 76 and 78 The centerbody primary air holes 118 are analogous to the liner primary air holes 102. Some of the primary air holes 118 are aligned radially with the carburetors 58 and 62, and some are positioned circumferentially therebetween and aligned generally radially with the centerbody upper primary dilution holes 108*a*.

In the exemplary embodiment illustrated, the centerbody 80 further includes conventional outer and inner film cooling air nuggets 120 at the upstream ends of the straight portions of the upper and lower surfaces 90*a* and 90*b* for conventionally channeling a portion of the compressed air 50 from the plenum 86 through the centerbody 80 to form cooling air boundary layers extending downstream over the outer surface 90 of the centerbody 80. The centerbody 80 also includes a plurality of longitudinally aligned holes 122 extending therethrough and inclined in the downstream direction at an angle B of about 20°. As illustrated in FIG. 4, the aft end 116 of the centerbody 80 also includes a plurality of circumferentially aligned cooling holes 122*b* also inclined at 20° relative to the circumferentially extending trailing edge 92.

Since the centerbody aft end 116 is arcuate, the cooling holes 122*b* are aligned circumferentially as described above for providing effective cooling of the aft end 116. The cooling holes 122 and 122*b* are substantially circular in longitudinal section and inclined at the angle B, and therefore form substantially an elliptical profile where they end at the centerbody outer surface 90. The cooling holes 122, 122*b* are preferably spaced from each other in the axial, or longitudinal direction at a distance $S_a$, and in the circumferential direction at a distance $S_c$ about 6½ diameters of the cooling holes 122, 122*b*. This relatively close spacing of the cooling holes 122, 122*b* provides for effective cooling of the centerbody 80 including its aft end 116.

The dilution air injector, in the form of the exemplary centerbody 80 described above, provides a new apparatus for practicing a new method of diluting the combustion gases by injecting the primary dilution air 110 through the primary dilution holes 108 for penetrating the combustion gases 76, 78, while additionally injecting the trim dilution air 114 through the trim dilution holes 112 for penetrating the combustion gases 76, 78 adjacent to the injected primary dilution air 110. In this way, the trim dilution air 114 is injected as a plurality of trim dilution jets adjacent to the primary dilution jets 110 for enhancing penetration and mixing for reducing combustion gas peak temperatures. The primary dilution holes 108 and the trim dilution holes 112 therefore cooperate with each other for controlling the placement of the dilution air 110, 114 for reducing hot streaks and temperature variation in the combustion gases 76 and 78.

Although the invention is described above with respect to the preferred centerbody 80, the use of the primary and trim dilution holes 108 and 112 may be effective as well in the outer and inner liners 64 and 66 for alternate combustor designs, as well as in alternate centerbody designs, such as radial centerbodies, wherever the introduction of dilution air is desired.

While there has been described herein what is considered to be a preferred embodiment of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A gas turbine engine combustor having a longitudinal axis, comprising:

(a) outer and inner liners extending downstream from outer and inner domes, respectively, to an annular combustor outlet, said outer and inner domes each including a plurality of circumferentially spaced outer and inner carburetors, respectively;

(b) a dilution air injector further comprising a plate having an upstream side for receiving compressed air and a downstream side for facing combustion gases, said plate being a hollow annular centerbody having upstream and downstream sides and extending downstream from between said domes and spaced radially from both said outer and inner liners, wherein:

(1) said centerbody upstream defines an annular plenum;

(2) said centerbody downstream side includes an upper surface and a lower surface converging to join each other at a trailing edge spaced upstream of said combustor outlet, said centerbody upper surface being spaced from said outer liner to define an outer combustion zone and said centerbody lower surface being spaced from said inner liner to define an inner combustion zone; and (3) said centerbody includes an inlet for channeling said compressed air into said plenum; and (c) said centerbody further including;

(1) an outer primary dilution hole disposed in said centerbody upper surface adjacent to said trailing edge for injecting a portion of said compressed air into said combustion gases as primary dilution air;

(2) an inner primary dilution hole disposed in said centerbody lower surface adjacent to said trailing edge for injecting a portion of said compressed air into said combustion gases as primary dilution air; and (3) a plurality of trim dilution holes disposed adjacent to said outer and inner primary dilution holes and adjacent to said trailing edge for injecting a portion of said compressed air into said combustion gases as trim dilution air.

2. A dilution air injector according to claim 1 wherein said primary dilution holes are larger than said trim dilution holes.

3. A dilution air injector according to claim 1 further including a pair of said inner primary dilution holes for each of said inner carburetors, and said outer primary dilution hole being disposed circumferentially therebetween.

4. A dilution air injector according to claim 3 wherein said trim dilution holes are disposed circumferentially between said pair of inner primary dilution holes.

5. A dilution air injector according to claim 1 wherein said trim dilution holes are aligned generally longitudinally with at least one of said outer and inner primary dilution holes.

6. A dilution air injector according to claim 1 wherein said trim dilution holes are aligned generally circumferentially with at least one of said outer and inner primary dilution holes.

7. A dilution air injector according to claim 1 wherein said trim dilution holes are aligned along an arc.

8. A dilution air injector according to claim 7 wherein said arc is concave and faces one of said outer and inner primary dilution holes.

9. A dilution air injector according to claim 1 wherein said centerbody has an arcuate aft end at said trailing edge in longitudinal section and said primary and trim dilution holes are disposed at least in part in said aft end for injecting said compressed air into said combustion gases at different angles.

10. A dilution air injector according to claim 9 wherein said centerbody upper and lower surfaces include straight portions extending upstream from said aft end and said primary dilution holes are disposed at least in part in said straight portions.

11. A dilution air injector according to claim 9 wherein said centerbody upper and lower surfaces further include primary air holes for injecting a portion of said compressed air as primary air for supporting combustion of said combustion gases.

12. A dilution air injector according to claim 11 wherein said centerbody upper and lower surfaces further include a plurality of longitudinally aligned and inclined cooling holes for cooling said centerbody.

13. A dilution air injector according to claim 12 wherein said centerbody aft end further includes a plurality of circumferentially aligned and inclined cooling holes for cooling said centerbody aft end.

* * * * *